US005701250A

United States Patent [19]

Wilson

[11] Patent Number: 5,701,250

[45] Date of Patent: Dec. 23, 1997

[54] SETTING BY PHONE FOR COUNTER RESETTABLE POSTAGE METERS

[75] Inventor: Michael Wilson, Trumbull, Conn.

[73] Assignee: Pitney Bowes Inc., Stamford, Conn.

[21] Appl. No.: 418,989

[22] Filed: Apr. 7, 1995

[51] Int. Cl.[6] ..... G07B 17/00

[52] U.S. Cl. ..... 364/464.13; 235/375; 235/382

[58] Field of Search ..... 364/464.02, 464.11, 364/464.13; 235/375, 382

[56] References Cited

U.S. PATENT DOCUMENTS

| | | | |
|---|---|---|---|
| 3,792,446 | 2/1974 | McFiggans et al. | 364/464.02 |
| 4,097,923 | 6/1978 | Eckert et al. | 364/464.02 |
| 4,202,489 | 5/1980 | Schubert | 235/101 |
| 4,280,179 | 7/1981 | Jones, Jr. et al. | 364/464.02 |
| 4,283,721 | 8/1981 | Eckert et al. | 340/680 |
| 4,347,506 | 8/1982 | Duwel et al. | 364/464.02 X |
| 4,509,780 | 4/1985 | Erwin | 292/307 R |
| 4,547,853 | 10/1985 | Eckert | 364/464.02 |
| 4,549,281 | 10/1985 | Eckert et al. | 364/464.02 |
| 5,058,025 | 10/1991 | Haines et al. | 364/464.02 |
| 5,237,506 | 8/1993 | Horbal et al. | 364/464.02 |
| 5,309,363 | 5/1994 | Graves et al. | 364/464.02 |
| 5,340,965 | 8/1994 | Horbal et al. | 235/101 |
| 5,369,401 | 11/1994 | Haines | 364/464.02 |

*Primary Examiner*—Edward R. Cosimano

*Attorney, Agent, or Firm*—Ronald Reichman; Melvin J. Scolnick

[57] ABSTRACT

This invention provides a secure environment to allow the customer to purchase postage for counter resettable postage meters. This invention allows the post office or agent to insure the accuracy and integrity of counter resettable meters by validating the counter resettable meter against a data center funding computer. The procedure would be as follows. The agent interfaces with a central computer where the serial number of the counter resettable postage meter is requested and entered, the contents of the ascending and descending registers are requested and entered. The computer checks as to the validity of the ascending and descending registers. The computer also checks the validity of that particular postage meter with respect to the customers physical location and status (lost or stolen, active). The customer requests and pays the postal agent for the amount of postage to be added to the meter. The computer system processes and verifies the added amount and transmits the approval to a postal agent. Thereupon, the postal agent then takes a key that opens that particular model meter and adjusts the descending register by the approved reset amount. The agent, then securely closes the postage meter with a key for that particular meter.

17 Claims, 2 Drawing Sheets

SETTING BY PHONE FOR COUNTER RESETTABLE POSTAGE METERS

FIELD OF THE INVENTION

This invention relates to counter resettable postage meters, and more particularly to a method for providing additional security and integrity for counter resettable postage meters.

BACKGROUND OF THE INVENTION

Postage meter resetting or recharging and recordkeeping operations for counter resettable postage meters are now highly dependent on manual routines by both the Postal Service and meter users. Post office employees have to visually inspect, open, recharge, and reseal the postage meters, in addition to filling out several different forms for recordkeeping purposes. These paths will continue to become more expensive as labor rates rise. The effort required to administer the metered mail system will rise in direct proportion to the number of postage meters in service.

In addition to the time required to recharge postage meters, there are occasional errors in recharging the meters which are usually not discovered until the user returns with the meter to his office. A return trip to the Post Office is then required to obtain the correct recharging.

Meter recharging is a reasonably complicated process involving large sums of money. Special training is required to maintain the records. The records may be in the form of cards. The records or cards are maintained at specific post offices and not in a central location. Thus, if a postal customer goes to a different post office than previously reset his postage meter, the card for that postage meter may not be present and it will be difficult if not impossible to recharge the meter.

The present recordkeeping system for counter resettable postage meters is completely manually administered. The postal agent is required to issue a receipt which contains all of the meter register readings before and after the recharging, along with the amount of the postage increment recharged into the meter. This recharging information is also entered into the customers daily record of meter register readings book and a complete transaction is entered into the post office records of the meter Settings book. Each post office has a transaction for the counter resettable meters that were brought to that particular post office. There is no central system for handling counter resettable meters. Unfortunately, the postal authorities have experienced a certain amount of leakage, i.e., fraud on behalf of the postal agent and/or the postal customer in the above system.

Another problem with the current system is that the post office has no method of validating the information that was in the postage meter.

The users of counter resettable meters are inconvenienced by the fact that they have to go to the same post office to reset their postage meter. Typically the postal meter customer has to wait in line to have their meter reset. It takes approximately twelve and one half minutes: to open the meter; for the customer to give money to the post office agent; and for the post office to increment the meter. Often times the post office may not rapidly find the correct records because a manual system is being used. This creates additional time delays.

Another disadvantage of the current counter resettable postage meter resetting system is that if the postage meter is stolen, the resetting post office may not be aware of the fact, because it takes considerable time for the records to be entered.

A postage by phone postage meter has been developed in which the customer may make a telephone call to add postage to the postage meter. In order to add postage to the meter the customer will have to enter the information contained in the descending and ascending registers as well as the postage meter serial number and the amount of postage that he or she would like to be added to the postage meter. The Postage by Phone system will perform a balance check, that is to check the registers. The above system will also check if the meter that postage is trying to be added to is a valid meter, i.e., the meter has not been reported stolen. A balance check of the ascending and descending registers will also be performed to verify that nobody interfered with this particular meter. The Postage by Phone system also takes a mixture of the data that it transmits to the postage meter and encrypts this data. The encrypted number will be entered into the postage meter to receive the postage that was paid for. The foregoing permits the postage meter to be checked for accuracy every time a reset is done and the customer has the ability to stay in his office and the post office is not directly involved.

There are approximately one million one hundred thousand counter resettable meters that are mechanical or electrical in the United States and Canada that have to be reset at the counter of the post office.

SUMMARY OF THE INVENTION

This invention overcomes the disadvantages of the prior art by providing a secure environment to allow the customer to purchase postage for counter resettable postage meters. This invention allows the post office or agent to insure the accuracy and integrity of counter resettable meters by validating the counter resettable meter against a data center funding computer. The procedure would be as follows. The agent interfaces with a central computer where the serial number of the counter resettable postage meter is requested and entered, the contents of the ascending and descending registers are requested and entered. The computer checks as to the validity of the ascending and descending registers. The computer also checks the validity of that particular postage meter with respect to the customers physical location and status (lost or stolen, active). The customer requests and pays the postal agent for the amount of postage to be added to the meter. The computer system processes and verifies the added amount and transmits the approval to a postal agent. Thereupon, the postal agent then takes a key that opens that particular model meter and adjusts the descending register by the approved reset amount. The agent, then securely closes the postage meter with a key for that particular meter. An advantage of the foregoing is that the post office is able to check the database of the counter resettable meters and determine if the meter was lost or stolen and the ascending and descending registers are in balance.

An additional advantage of this invention is that the post office is provided with information ,that pertaining to the buying habits of particular post office customers.

A further advantage of this invention is that the post office will have an idea regarding how much mail it will expect to receive from different post offices because the post office will know that someone who has just purchased postage is likely to use that particular meter.

An additional advantage of this invention is that the post office improves the meter integrity by prevalidating all transactions.

An additional advantage of this invention is that it allows the Postal Service to improve its cash management process by providing to the Postal Service instant reset purchases by post office location.

DETAILED DESCRIPTION OF THE PREFERRED EMBODIMENT

Figure 1:
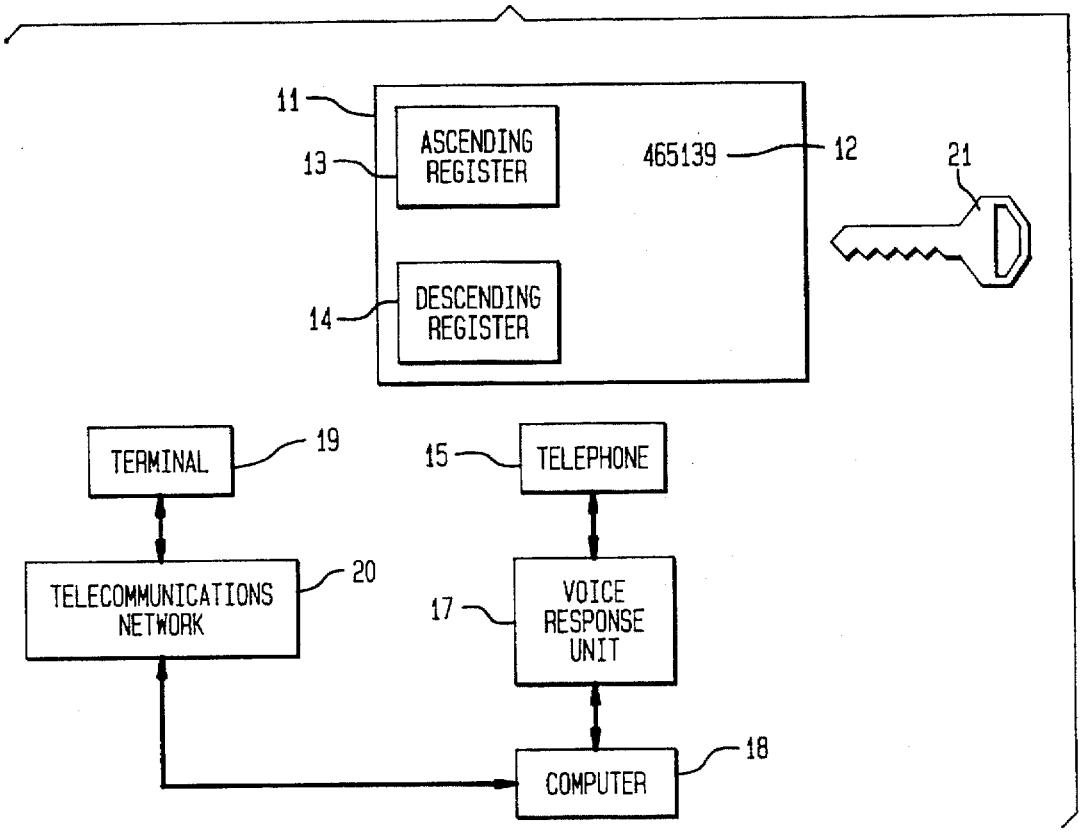
FIG. 1 is a block diagram of this invention.

Referring now to the drawings in detail, and more particularly to FIG. 1, the reference character 11 represents a counter resettable postage meter that the customer has brought to the post office. Counter resettable postage meter 11 includes: a serial number 12; an ascending register 13 and a descending register 14. As is known in the art, the ascending register 13 maintains a record of all the postage dispensed by the postage meter 11 and the descending register 14 maintains a record of the amount of postage that has been purchased by the user and which is available to be dispensed. A telephone 15 located in the post office is used by a postal agent to communicate with voice response unit 17. Telephone 15 is coupled to an interactive voice response unit 17. Voice response unit 17 provides an interface between the customer translating voice information to computer 18 and from the information coming from computer 18. Computer 18 will request from the postal agent the serial number 12 of meter 11, and the contents of ascending register 13 and descending register 14. Computer 18 will verify that the serial number for meter 11 is correct and that meter 11 has not been reported lost or stolen. Computer 18 also verifies the status of meter 11, the customer's status, and the validity of registers 13 and 14. If everything is correct, computer 18 will request the amount of postage to be added to descending register 14 of meter 11. Once the postal agent states that money was received, computer 18 will approve the transaction for the update to descending register 14 of meter 11 by giving the postal agent an approval code that will tell the agent what to enter in register 14. The postal agent uses key 21 to open meter 11 so that the agent can enter the correct data. If computer 18 states that every thing is not valid an option to redo the transaction or transfer to a customer agent is offered.

Terminal 19 is coupled to a telecommunications network 20 and computer 18 and may be used instead of or in conjunction with telephone 15 and voice response unit 17. The serial number 12, the contents of ascending register 13 and descending register 14 may be entered via terminal 19 through telecommunications network 20. The foregoing information will be transmitted to computer 18. Computer 18 will verify that the serial number 11 is correct and that meter 11 has not been reported lost or stolen. Computer 18 also verifies the status of meter 11, the customer's status, and the validity of registers 13 and 14. If everything is valid, computer 18 will process the amount of postage to be added to postage meter 11. Once the agent certifies that the money was received, computer 18 will approve the transaction and update meter 11 by transmitting via network 20 an approval code that will be displayed on terminal 19 to inform the postal agent what to enter in register 14. The postal agent uses key 21 to open meter 11 so that the agent can enter the correct data. If computer 18 states that every thing is not valid an option to redo the transaction or transfer to a customer agent is offered.

Figure 2:
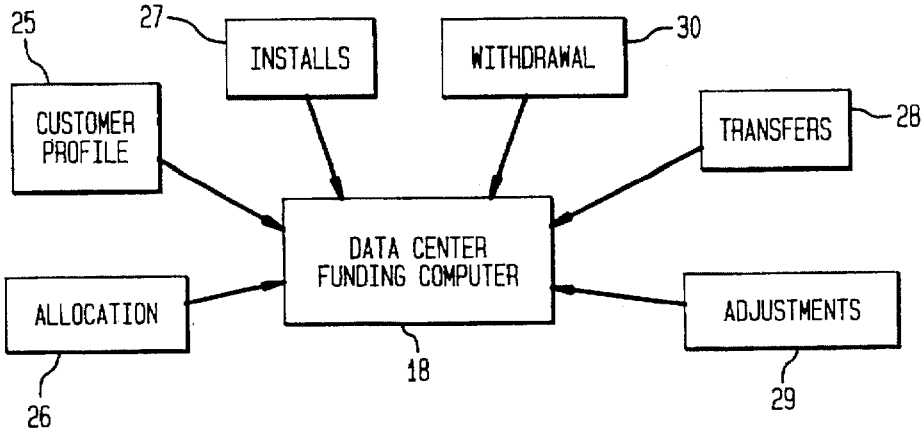
FIG. 2 is a diagram showing the major components that affect the maintenance of a data center funding computer.

FIG. 2 is a diagram outlining the major components that affect the maintenance of data center funding computer 18. Information regarding the customer i.e. customer profile 25 is entered into computer 18. The customer profile includes the name of the customer, the address where the customer intends to keep the meter, etc. Information regarding the product profile 49 is entered into computer 18. The product profile includes the model number, serial number, manufacturing code, meter status, register information (format and content) etc. Character 26 designates the allocation of a particular meter to the customer. Information regarding the allocation of the meter for a specific customer is entered into computer 18 and subsequently edited and verified by computer 18. Information regarding the installation 27 of the allocated meter is entered into computer 18 which edits and verifies the information. Information regarding fund transfers 28 are entered into computer 18, which edits and verifies the information. Information regarding adjustments 29 are entered into computer 18, which edits and verifies the information. Information regarding withdrawal 10 of the meter from a customer location is entered into computer 18, which edits and verifies the information. Information regarding replacement 50 of a defective meter from a customer location is entered into computer 18, which edits and verifies the information.

Figure 3:
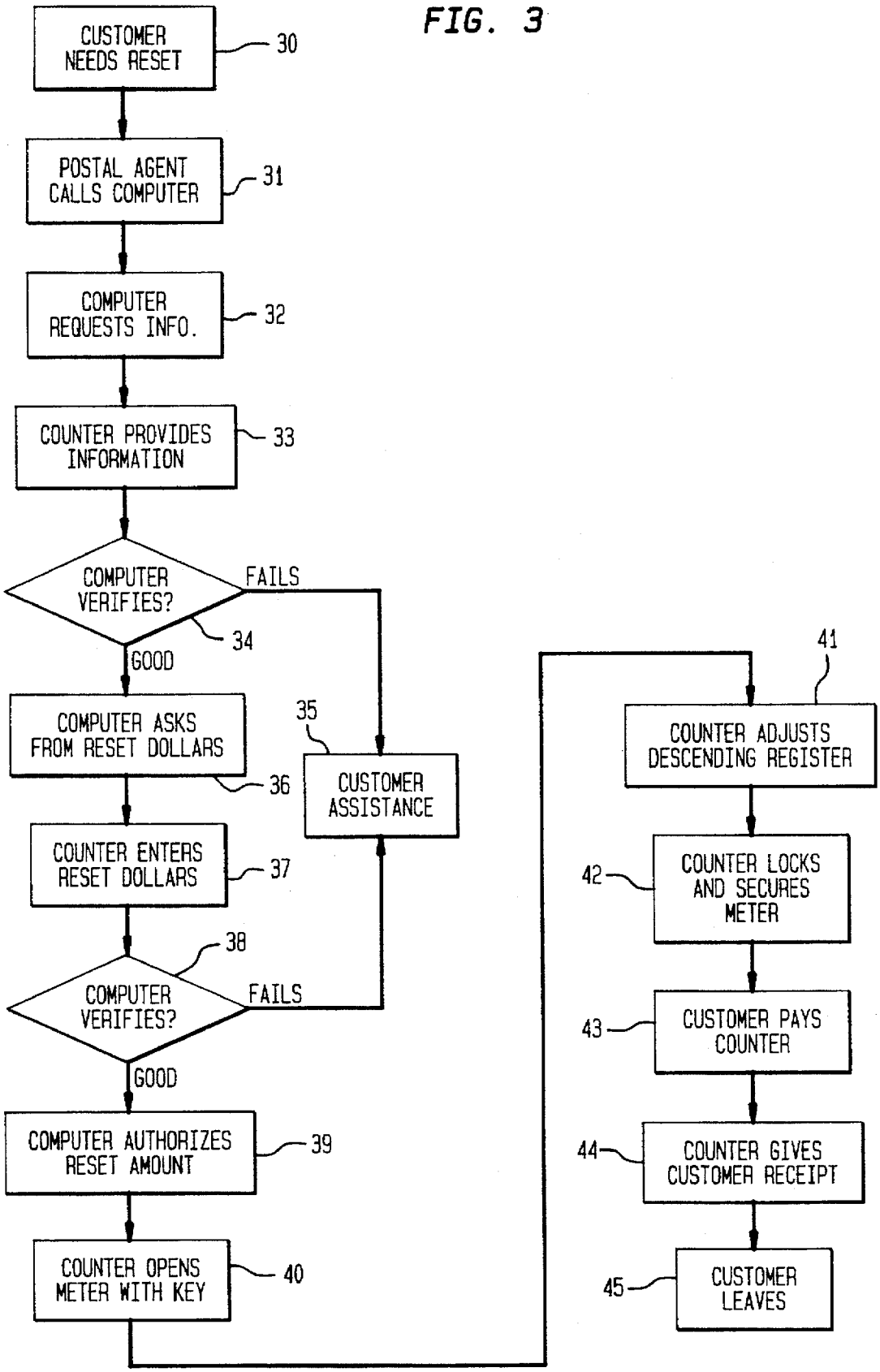
FIG. 3 is a flow chart of the steps used by this invention.

FIG. 3 is a flow chart of the steps used in this invention. In step 30 the customer determines whether or not their meter 11 requires a reset, and if necessary the customer takes meter 11 to the postal counter. In step 31, the postal agent contacts computer 18 via telephone 15. In step 32 computer 18 requests information from the postal agent regarding meter 11. The postal agent provides the information requested by the computer in block 33. Computer 18 verifies in block 34 the information supplied by the agent. In the event that the information supplied by the agent is not valid i.e., incorrect computer 18 requests that a customer assistance agent be notified in block 35. The customer assistance agent will check into the matter and resolve the issue. In the event that computer 18 verifies that the agent provided information is correct, computer 18 in block 36 will request the amount of reset dollars that the customer wants added to meter 11. The postal agent informs computer 18 in block 37 the amount of reset dollars that the customer wants entered into meter 11. In block 38 the computer 18 verifies with the postal agent that the requested amount of reset dollars may be added to the particular specific meter 11. In the event that the verification fails a customer assistance representative is notified in block 35 where the issue is addressed. If the verification is deemed to be correct computer 18 authorizes the postal agent in block 39 the requested reset amount to be entered into meter 11. In step 40 of the postal agent opens meter 18. The postal agent in step 41 adjusts the descending register 14 with the requested reset amount. After the requested reset amount is entered into descending register 14 the postal agent closes and secures meter 11 in block 42. At this juncture the customer pays the agent in block 43 and the postal agent gives the customer a receipt for the amount of reset requested in block 44. At this time the customer takes postal meter 11 and leaves the agent in block 45.

The above specification describes a new and improved counter resettable postage meter system for the prevalidation of counter resettable postage meters. It is realized that the above description may indicate to those skilled in the art additional ways in which the principals of this invention may be used without departing from the spirit. It is, therefore, intended that this invention be limited only by the scope of the appended claims.

What is claimed is:

1. A method of funding a mechanical postage meter with a variable amount of postage, the postage meter having means for entering postage manually, the method comprising the steps of:

a. establishing a data center funding computer that has a plurality of data bases and is remote from the postage meter;

b. establishing communication with the data center funding computer;

c. entering into the data bases of the data center funded computer data identifying the postage meter to be funded;

d. entering into the data bases of the data center funding computer data representing a desired variable amount of postage to be entered into the means for entering postage manually of the postage meter;

e. processing and validating the data representing the postage meter, desired variable amount of reset postage requested to ensure accuracy, integrity and security;

f. authorizing the reset of the postage meter with the postage when valid data is obtained in step e;

g. updating the data bases of the data center funding computer to reflect the added postage;

h. opening the postage meter;

i. physically adjusting the descending register in the meter with the approved added postage; and j. closing the postage meter.

2. The method of claim 1, further including the steps of:

installing a postage meter at a customer location;

ensuring all postage meter registers are validated and balanced in anticipation of an initial reset.

3. The method of claim 1, further including the steps of:

withdrawing a postage meter from an existing customer location; verifying all postage meter registers; and balancing all postal meter registers prior to removal of the postage meter.

4. The method of claim 1, further including the steps of:

transferring the available funds from the postage meter descending register to another postage meters descending register.

5. The method claimed in claim 1 wherein the authorizing step includes the steps of:

communicating the authorized reset postage amount to the postal agent; and having the postal agent acknowledge the receipt of the authorized dollar amount.

6. The method claimed in claim 1, wherein the opening step further includes:

accessing a secure postage.

7. The method claimed in claim 1, wherein the closing step further includes:

restoring the postage meter to a secure state.

8. The method claimed in claim 1, wherein establishing communications is via telephone.

9. The method claimed in claim 1, wherein establishing communications is via terminal.

10. The method of claim 1, wherein the processing step further includes the steps of:

ensuring the customer has a valid profile;

ensuring that the postal meter has been assigned to the correct account; and ensuring the postage meter has a valid status and accurate registers.

11. The method claimed in claim 1, further including the steps of:

maintaining the data center funding computer.

12. The method claimed in claim 11, wherein the maintaining step includes the steps of:

establishing an approved customer profile; and changing the customer profile with updated information.

13. The method of claim 11, wherein the maintaining step includes the steps of:

assigning an available and valid postage meter serial number to an existing customer.

14. The method of claim 1, wherein the processing step further includes the steps of:

ensuring the customer has a valid profile.

15. The method of claim 14, wherein the ensuring step further includes the steps of:

validating the customer account number;

checking the customer status code to determine if the status code is active;

determining the manufacturer of the postage meter;

checking the address format.

16. The method of claim 14, wherein the processing step further includes the steps of:

ensuring the postage meter has a valid status and accurate registers.

17. The method of claim 16, wherein the ensuring step further includes the steps of:

checking the postage meters serial number;

determining that the postage meter has the correct register lengths;

determining that the postage meter has the correct number of decimal places;

determining that the postage meter is active; and determining that the contents of the ascending and descending registers balance and are in agreement with the data stored in the data center funding computer.

* * * * *